US007213546B2

(12) United States Patent
Vermeer

(10) Patent No.: US 7,213,546 B2
(45) Date of Patent: May 8, 2007

(54) ENGINE AIRFLOW MANAGEMENT SYSTEM

(76) Inventor: Steven Vermeer, 1762 Stage Coach Rd., Shakopee, MN (US) 55379

( * ) Notice: Subject to any disclaimer, the term of this patent is extended or adjusted under 35 U.S.C. 154(b) by 0 days.

(21) Appl. No.: 10/102,785

(22) Filed: Mar. 21, 2002

(65) Prior Publication Data

US 2002/0148420 A1 Oct. 17, 2002

Related U.S. Application Data

(60) Provisional application No. 60/277,762, filed on Mar. 21, 2001.

(51) Int. Cl.
*F01L 7/00* (2006.01)

(52) U.S. Cl. ..... 123/80 BA

(58) Field of Classification Search ..... 123/80 BA, 123/190.1, 190.12, 190.2, 190.8
See application file for complete search history.

(56) References Cited

U.S. PATENT DOCUMENTS

| | | | | |
|---|---|---|---|---|
| 1,079,741 | A | 11/1913 | Calkins et al. | |
| 1,527,605 | A | 2/1925 | Prescott | |
| 1,775,581 | A | 9/1930 | Baer | |
| 4,481,917 | A | 11/1984 | Rus et al. | |
| 4,506,636 | A | 3/1985 | Negre et al. | |
| 4,751,900 | A * | 6/1988 | Ruffolo | 123/190.8 |
| 4,864,985 | A | 9/1989 | Slee | |
| 4,920,934 | A | 5/1990 | Pizzicara | |
| 5,205,251 | A * | 4/1993 | Conklin | 123/190.12 |
| 5,343,841 | A | 9/1994 | Hattori et al. | |
| 5,392,743 | A * | 2/1995 | Dokonal | 123/190.1 |
| 5,410,996 | A * | 5/1995 | Baird | 123/190.2 |
| 5,503,124 | A * | 4/1996 | Wallis | 123/190.1 |
| 5,706,775 | A * | 1/1998 | Schweter et al. | 129/190.12 |
| 5,738,051 | A | 4/1998 | Binversie et al. | |
| 5,749,335 | A | 5/1998 | Flanery, Jr. et al. | |
| 6,006,714 | A * | 12/1999 | Griffin et al. | 123/190.1 |
| 6,055,953 | A * | 5/2000 | Weickel et al. | 123/190.1 |
| 6,293,242 | B1 * | 9/2001 | Kutlucinar | 123/190.8 |
| 6,308,677 | B1 * | 10/2001 | Bohach et al. | 123/190.8 |

* cited by examiner

*Primary Examiner*—Stephen K. Cronin
*Assistant Examiner*—Jason Benton
(74) *Attorney, Agent, or Firm*—Leffert Jay & Polglaze, P.A.

(57) ABSTRACT

A rotary valve assembly for an internal combustion engine is herein disclosed. The rotary valve assembly comprises a valve body having a number of ports formed therethrough and a bore that intersects these ports such that a valve cylinder inserted into the bore may selectively occlude or open the ports of the valve body. Cutouts formed into the valve cylinder facilitate the opening of the ports as they are rotated into alignment with the ports of the valve body. The rotary valve assembly may be used as a throttle mechanism by sliding the valve cylinder longitudinally within the bore of the valve body so as to control the aspect of the cutouts or bores formed into the valve cylinder that is presented to the ports.

24 Claims, 7 Drawing Sheets

ENGINE AIRFLOW MANAGEMENT SYSTEM

This application claims benefit of Provisional U.S. Appl. No. 60/277,762, filed Mar. 21, 2001.

FIELD OF THE INVENTION

The present invention relates to an intake/exhaust valve for an internal combustion engine and more specifically to a rotary intake/exhaust valve that may also incorporate a throttling mechanism.

BACKGROUND OF THE INVENTION

Virtually all internal combustion engines on the market today utilize poppet type valves. FIGS. 1–4 illustrate schematically a single cylinder of a prior art internal combustion engine having typical poppet-type intake and exhaust valves installed therein. The poppet valve assembly 20 illustrated in FIGS. 1–4 typically resides in the head 22 of the internal combustion engine 2. Head 22 is bolted to the block 24 of the engine 2 immediately over cylinder 26. Piston 28 is slidably received within cylinder 26 in close fitting conformity therewith. The crank arm 30 is coupled between the piston head 28 and crankshaft 32, thereby translating the reciprocating, linear motion of the piston head 28 within the cylinder 26 into rotary motion about the axis of rotation of the crankshaft 32. The internal combustion engine 2 illustrated in FIGS. 1–4 is a four-stroke engine.

Poppet valves 34 have heads 36 that have cone shaped or beveled edges that mate with cooperating beveled edge of a valve seat 38 formed into the head 22. Poppet valve rods 40 extend rearwardly from the poppet valve heads 36 through valve guide bores 42 formed through the head 22. Poppet valves 34 are reciprocated longitudinally so as to selectively open and close an intake port 44 and an exhaust port 46 formed through the head 22. The poppet valves 34 are actuated between open and closed positions by a camshaft 48 having a plurality of cams 50 extending therefrom. As camshaft 48 rotates, the cams 50 strike lifters 52 which pivot so as to force poppet valve 34 into cylinder 26 thereby permitting fluidic communication with the interior of cylinder 2 through the ports 44, 46. It is to be understood that there exist many different variations on such an engine and that the prior art embodiment described in conjunction with FIGS. 1–4 is illustrative only.

Even from the schematic representations of the prior art poppet-type valve assembly 20 illustrated in FIGS. 1–4, it can be appreciated that a poppet valve assembly 20 is a very complicated structure. The costs associated with manufacturing, assembling, and maintaining such an assembly are quite high. Furthermore, the airflow characteristics associated with poppet valve assembles 20 are relatively inefficient as air, fuel, and combustion gases must enter or exist the cylinder 26 through a relatively small annular opening created between the poppet valve head 36 and valve seat 38 when the poppet valves 34 are opened. Therefore, entry of air or an air/fuel mixture into the cylinder at the beginning of an induction stroke of a four-stroke internal combustion engine may not be complete, and similarly, the flushing of combustion gases that takes place during the exhaust stroke may not be complete either. This situation typically results in less than ideal combustion within the cylinder 26.

Because of the tight tolerances necessary for a poppet-type valve assembly 20 to function properly, a great deal of care is required in both the manufacture and maintenance of the poppet valves 34. Because of the rigorous stresses to which poppet valves 34 are subjected, these valves may quickly wear, thereby degrading the seal that is formed between the beveled or cone shaped edges of the poppet valve head 36 and the valve seat 38. Furthermore, it is not uncommon for either the cone shaped edge of the poppet valve head 36 or the cooperating edge of the valve seat 38 to become pitted through use. In either case, the degree of compression that may be achieved within a cylinder 26 is lowered significantly.

Because a poppet-type valve assembly is such a complex mechanism, it is difficult to arrange an engine's components into a given engine compartment space. The arrangement of an engine's components is typically referred to as the "packaging" of the engine. The packaging of an engine may dictates the size and shape and also the location of the physical components thereof. The complexity and fragility of a poppet-type valve assembly 20 typically requires that the valve assembly 20 be readily accessible. Usually this means that the valve assembly 20 must be near the top of the engine 2. The difficulty in positioning the valve assembly 20 is further complicated by the need to provide cooling to the assembly. The engine block 24 and head 22 are typically cooled by running a coolant through passage such as passages 23. Such coolant passages 23 may not be able to sufficiently cool the valve assembly 20 when the engine 2 is under high stress. Subsequently, valve assemblies 20 may quickly become overheated and may become damaged.

Traditionally, internal combustion engines 2 using poppet-type valve assemblies 20 and particularly gasoline powered engines require the use of a carburetor or fuel injection system and mix and supply the requisite quantity of fuel and air so that the engine 2 may operate at a desired speed. These mechanisms are typically even more complex than the poppet valve 20 and correspondingly more expensive.

Accordingly, it is an object of the present invention to provide a rotary valve mechanism that is simple to manufacture and maintain, and that is also flexible enough to greatly simplify the packaging of the components of an engine. It is another object of the present invention to provide a rotary valve that increases the efficiency of air flow to and from a cylinder of an internal combustion engine and which allows for more complete combustion of the fuel supplied to the engine. Yet another object of the present invention is to provide a rotary valve that may incorporate a throttling mechanism that will obviate the need for a carburetor or fuel injection system as such. It is yet another object of this invention to provide a rotary valve assemble that may be easily constructed and arranged to simply replace a more complex poppet valve assembly.

These and other objectives and advantages of the invention will appear more fully from the following description, made in conjunction with the accompanying drawings wherein like reference characters refer to the same or similar parts throughout the several views.

SUMMARY OF THE INVENTION

The objects of the present invention are realized in a rotary valve mechanism that comprises a valve body that has a bore formed therein with at least one port formed therethrough that intersects the bore. A valve cylinder is constructed and arranged for rotation within the bore of the valve body and has at least one cutout that corresponds to the port formed through the valve body. The cutout is formed such that as the valve cylinder rotates within the valve body, the cutout will selectively permit fluidic communication through the port of the valve body as the valve cylinder rotates within the bore. It is to be understood that there can be more than one port or cutout formed in the rotary valve mechanism and that preferably the rotary valve mechanism is constructed and arranged so as to implement the proper valve sequence of a four-stroke internal combustion engine.

The cutouts formed in the valve cylinder may have numerous shapes including regular geometric shapes cut into the face of the valve cylinder but may also be formed into more complex geometric shapes in order to control the flow of fluids and gases therethrough in a particular manner. Specifically, the cutouts formed in the valve cylinder may comprise channels that extend longitudinally and/or circumferentially around and along the valve cylinder. Such channels may increase, decrease, and otherwise modify the flow of combustion gases through the valve mechanism. Note that it is preferred that the cutouts be formed entirely on the exterior of the valve cylinder.

While the rotary valve mechanism of the present invention is ideally suited for use with a four-stroke internal combustion engine, it is also to be appreciated that this rotary valve mechanism may be utilized with virtually any type of internal combustion engine, including two-stroke engines, diesel engines, natural gas engines and the like.

In operation and in an embodiment adapted for use with a four-stroke internal combustion engine, the valve body of the rotary valve mechanism will comprise an intake cutout and an exhaust cutout that are periodically rotated into and out of fluidic communication with respective intake ports and exhaust ports formed through the valve body. The rotation of the valve cylinder within the valve body selectively permits fluidic communication through the rotary valve mechanism in order to facilitate the operation of the engine. In general, the valve cylinder will rotate at approximately one-half the rate at which the crank shaft of the engine rotates where adapted for use with a four-cylinder engine and at approximately the same speed as the crankshaft when used with a two-cycle engine. However, it is to be understood that in various embodiments, the rate of rotation of the rotary valve cylinder may be altered as applications require.

In an alternate embodiment of the present invention, an exhaust gas return valve (EGR valve) comprising a small channel formed either on the outer surface of the valve cylinder or through the body of the valve cylinder between the intake and exhaust ports may be included with the rotary valve mechanism. Typically, the channel that forms the EGR valve will have a predetermined diameter or cross-sectional area so as to meter the amount of combustion gases that may flow therethrough. The timing with which these exhaust gas return valves create fluidic communication between the intake ports and exhaust ports of the rotary valve mechanism will vary with the application and tuning of the engine.

One of the benefits of the rotary valve mechanism of the present invention is that the intake port cutout may be constructed and arranged to remain open during substantially an entire induction stroke of the four-stroke engine. What is more, the intake port cutout will typically fully open the intake port within 45 degrees of rotation of the crankshaft to which the valve cylinder is coupled. The solid cross-sectional area of the ports offers a much greater flow capability than the annular flow area presented by a typical prior art poppet valve. And, as the intake port typically remains open for between 180 and 182 degrees of rotation of the crankshaft to which the valve cylinder is coupled, larger quantities of fuel/air mixture burned in the cylinders may be brought into the cylinder for combustion.

Similarly, the exhaust port in a rotary valve mechanism according to the present invention will open earlier and close later than typically is possible for a poppet type valve. Specifically, the exhaust port will port will generally begin to open at between 535 and 540 degrees of rotation of the crankshaft to which the valve cylinder is coupled as measured from top dead center of the beginning of an engine cycle. The exhaust port will become fully open within 45 degrees of rotation of the crankshaft once it has started to open, and as indicated above, its flow area is typically much larger than that of the annular flow port created by a poppet type valve. Generally, the exhaust port will become fully closed at approximately 18 degrees after top dead center at the beginning of an engine cycle.

Another feature of the present invention is that by moving the valve cylinder longitudinally within the bore in the valve body one may control the aspect of the port cutout that is exposed to its corresponding port. What this means is that the flow of gases through the rotary valve mechanism may be controlled and the rotary valve mechanism of the present invention may therefore be used as a throttle. Where the rotary valve mechanism is utilized as a throttle, the valve cylinder will be longitudinally slidable within the bore formed through the valve body and will typically extend entirely through the bore and extend from either side of the valve body itself. The first end of the valve cylinder will be operatively coupled to a crankshaft of the internal combustion engine so as to transmit the rotation of the crankshaft to the valve cylinder in a predetermined ratio. In a four-cylinder engine, this ratio will typically be on the order of one-half the speed of the crankshaft, and in a two-cycle engine, the valve cylinder will rotate at approximately the same speed as the crankshaft. The second end of the valve cylinder extending from the valve body will typically have a biasing mechanism coupled thereto that longitudinally biases the valve cylinder into a first, idle position. It is important to make sure that the valve cylinder be biased into its idle position to avoid unwanted acceleration of the engine speed. In one embodiment, this biasing mechanism is simply a spring coupled to the valve cylinder. An actuation mechanism, which may be as simple as a lever that bears against the valve cylinder, is constructed and arranged to move the valve cylinder longitudinally within the valve body between its first, idle position and a second, wide open position. Note that this biasing mechanism may position the valve cylinder at any desired position between its first and second positions so as to selectively operate the engine at a predetermined rate.

Though a preferred embodiment of the present invention utilizes a valve cylinder that selectively permits fluidic communication through a valve body by means of one or more cutouts formed in the exterior thereof, it is possible to replace the cutouts with a bore or bores formed through the valve body itself. This is particularly desirable when adapting the rotary valve mechanism of the present invention for use with a two-stroke internal combustion engine. The bore or bores formed through the valve body will be constructed and arranged to address their respective ports so as to permit the operation of the two-cylinder engine. In addition, the valve cylinder may also be constructed and arranged so that the rotary valve mechanism may be used as a throttle as described above.

DETAILED DESCRIPTION

Although the disclosure hereof is detailed and exact to enable those skilled in the art to practice the invention, the physical embodiments herein disclosed merely exemplify the invention, which may be embodied in other specific structure. While the preferred embodiment has been described, the details may be changed without departing from the invention, which is defined by the claims.

A valve assembly constructed according to the present invention may be readily adapted for use with four stroke and two stroke engines as well as with engines that operate on more complex principles. Furthermore, the present invention may be utilized with engines that burn gas, diesel, natural gas, kerosene or other combustibles.

Throughout this specification, top dead center refers to the uppermost position of the piston 28 within the cylinder 26. The lowermost position of the piston 28 within cylinder 26 is known as bottom dead center. The piston 28 reciprocates within the cylinder 26 between top dead center and bottom dead center. The four stroke cycle of an engine results in the rotation of the crankshaft 30 through 720°. Top dead center at the beginning of the induction stroke is the point of reference for the cycle and is designated as 0°. All positions of the crankshaft 32 during the engine's cycle can be and are referenced to the 0° starting point.

Figure 1:
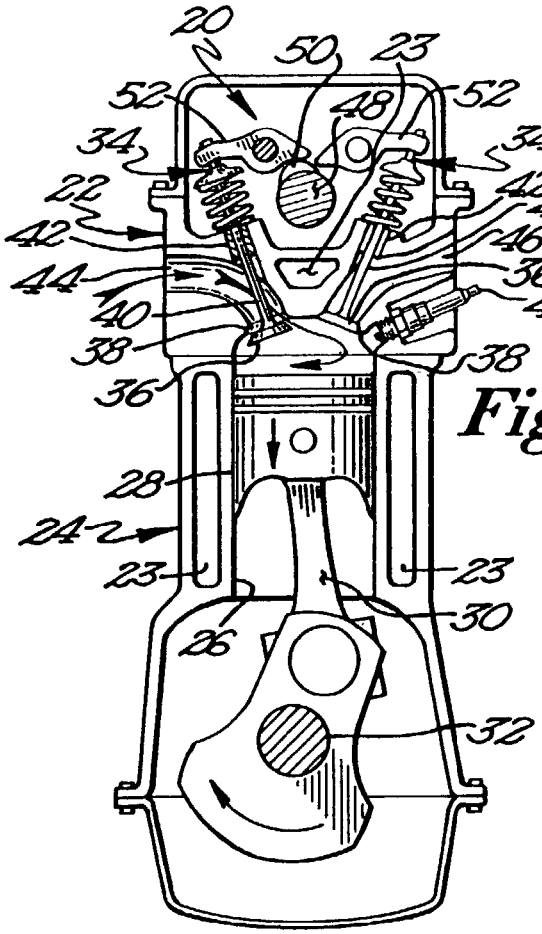
Fig 1 PRIOR ART
FIG. 1 is a cross-sectional schematic representation of a single cylinder of a prior art four-stoke internal combustion engine that utilizes poppet type valves. The piston of the engine illustrated in FIG. 1 is at the beginning of the induction stroke of the four-stoke cycle of the engine.
Figure 2:
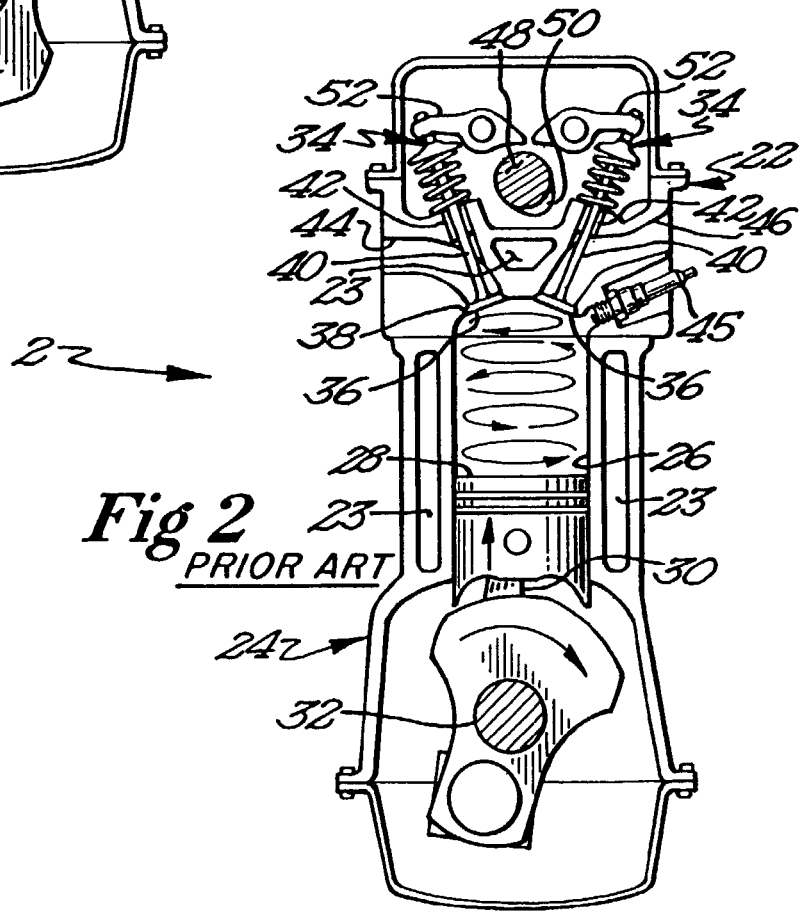
Fig 2 PRIOR ART
FIG. 2 is a cross-sectional schematic representation of the prior art engine of FIG. 1 wherein the piston of the engine has completed the induction stroke and is beginning the compression stroke of the four-stroke cycle of the engine.
Figure 3:
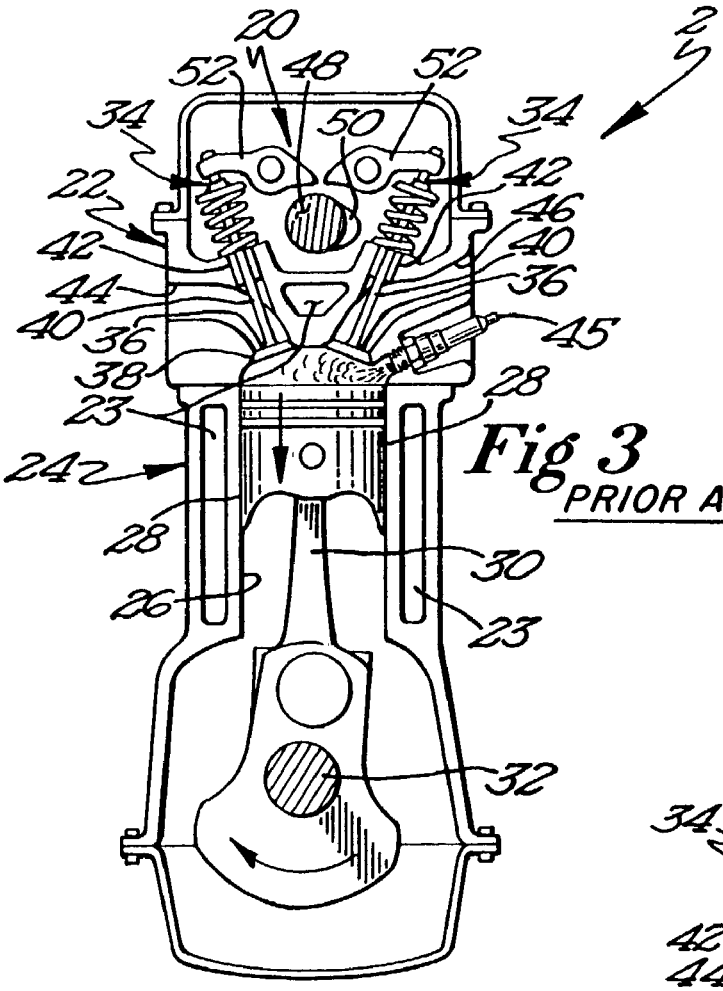
Fig 3 PRIOR ART
FIG. 3 is a cross-sectional schematic of the prior art engine of FIG. 1 wherein the piston is beginning the power stroke of the four-stroke cycle of the engine.
Figure 4:
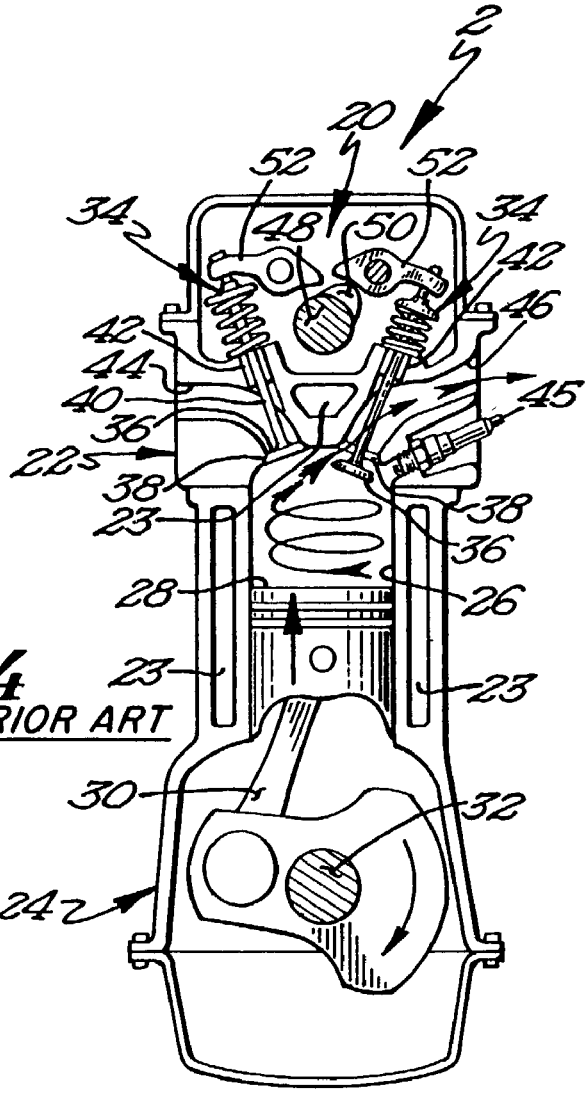
Fig 4 PRIOR ART
FIG. 4 is a cross-sectional schematic representation of the prior art engine of FIG. 1 wherein the piston of the engine has completed its power stroke and is beginning the exhaust stroke of the four-stroke cycle of the engine.

As indicated above, in operation the crankshaft 32 of a four-stroke internal combustion engine 2 rotates 720 degrees in order to complete a full cycle. The respective strokes of the four stroke cycle are generally referred to as the induction, compression, combustion, and exhaust strokes. FIGS. 1–4 illustrate this four stroke cycle as implemented in a prior art engine 2 comprising a poppet-type valve assembly 20. In FIG. 1 engine 2 is illustrated with its crankshaft 32 and piston head 28 positioned near tope dead center at the beginning of the first, induction stroke. During the induction stroke, the valve assembly 20 must open for so as to admit air or an air/fuel mixture into the cylinder. During the second, compression stroke of the four stroke cycle (illustrated in FIG. 2), the valve assembly 20 is closed so that as the piston 28 moves from bottom dead center toward top dead center, the air or fuel/air mixture in the cylinder 26 is compressed. In a four stroke diesel engine, fuel is typically injected into the cylinder during this stroke. By the time the piston 28 reaches top dead center of the compression stroke, combustion of the fuel/air mixture within the cylinder has occurred and the piston 28 is driven back towards bottom dead center in its combustion stroke (see FIG. 3). The valve assembly 20 remains closed through the greater part of the combustion stroke so that the pressure within the cylinder 26 may be transferred to the crankshaft 32. As the combustion stroke is completed, the piston 28 moves from bottom dead center toward top dead center once again. See FIG. 4. The valve assembly 20 remains open during the exhaust stroke to vent the combustion gasses from the cylinder 26.

The position of the poppet valves 34 with respect to the piston 28 of engine 2 during the four stroke cycle illustrated in FIGS. 1–4 is as follows. Typically an intake poppet valve 34 will begin to open between 35° and 40° before top dead center of the induction stroke, i.e. 35°–40° before the 0° reference for the four stroke cycle of the engine 2. Note that when referring to the opening and closing of a poppet type valve, it is common to refer to a $^{50}/_{1000}{}^{th}$ rule. That is, a poppet valve will be said to be open once it has traveled $^{50}/_{1000}{}^{th}$ of an inch and similarly will be considered closed when it is within $^{50}/_{1000}{}^{th}$ inches of being fully seated. This rule simply recognizes that only negligible airflow through the valve occurs when the poppet valve is within $^{50}/_{1000}{}^{th}$ inches of its seat. This rule also applies to the present invention.

It is preferred to have both the intake port and exhaust port of a poppet type valve assembly 20 open simultaneously near the beginning of the induction stroke of the engine 2 in order to create an air flow that will draw in the fuel/air mixture and force our exhaust gases. However, the exhaust port poppet valve will typically not close until the crankshaft 32 of the engine 2 has rotated approximately 25° past top dead center into the induction stroke. What is more, the poppet type valve of the intake port will not achieve its fully open position until the crankshaft 32 has rotated through approximately 105°–115°.

The exhaust port of a poppet type valve assembly 20 will remain closed through the compression stroke of engine 2. However, the poppet valve 34 of the intake port will not usually be closed until the crankshaft 32 has rotated through approximately 235°–240° (55°–60° past bottom dead center).

During the power stroke of the engine 2, the poppet valve 34 of the exhaust port will begin to open at approximately 55°–60° before bottom dead center or at approximately 480°–485° of crankshaft 32 rotation. The exhaust poppet valve 34 will thereafter be fully opened at between 605°–615° of crankshaft rotation.

From this description of a typical poppet type valve assembly 20 it can be appreciated that poppet type valves tend to open very early and also close late. In addition, these types of valves take longer to achieve their fully opened positions. This situation results in generally lower compression or in lower quality compression and also contributes to inefficient combustion of fuel in the engine 2.

Figure 5:
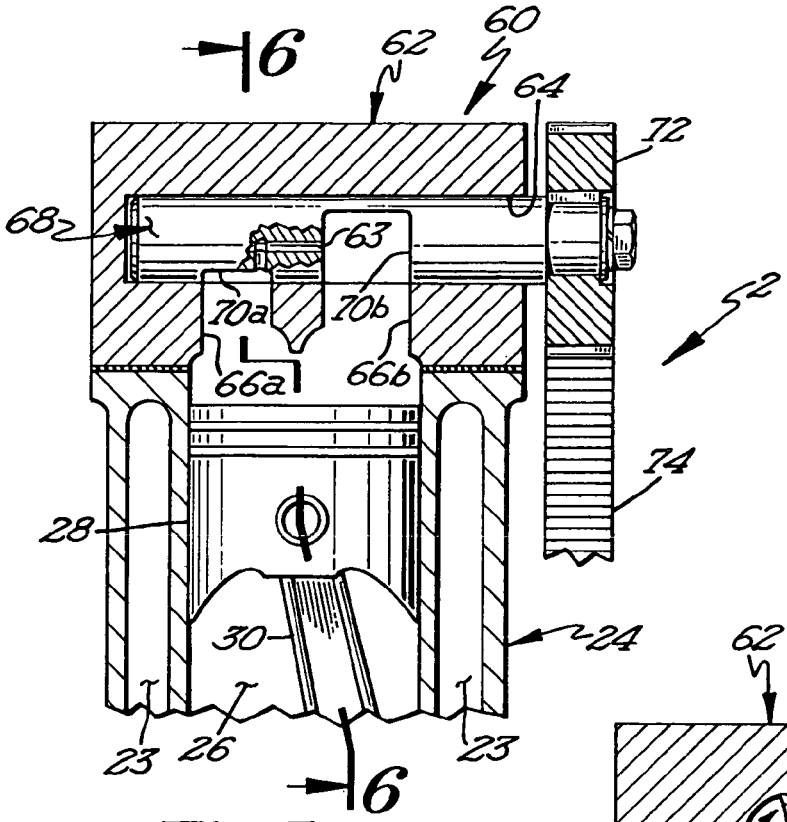
FIG. 5 is a cutaway, cross-sectional schematic illustration of a rotary valve of the present invention mounted over a cylinder of an internal combustion engine.
Figure 6:
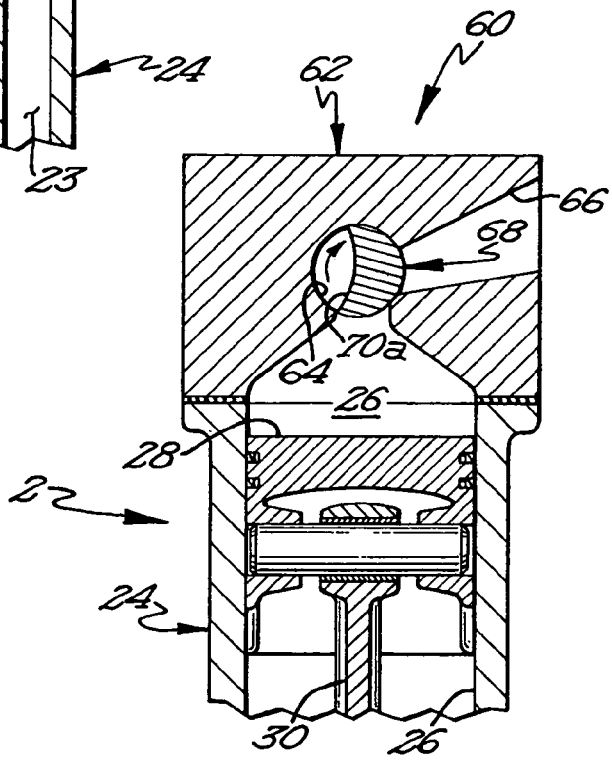
FIG. 6 is a schematic cross-section of a rotary valve taken along cutting lines 6—6 in FIG. 5, showing the valve cylinder of the rotary valve in a closed position.
Figure 7:
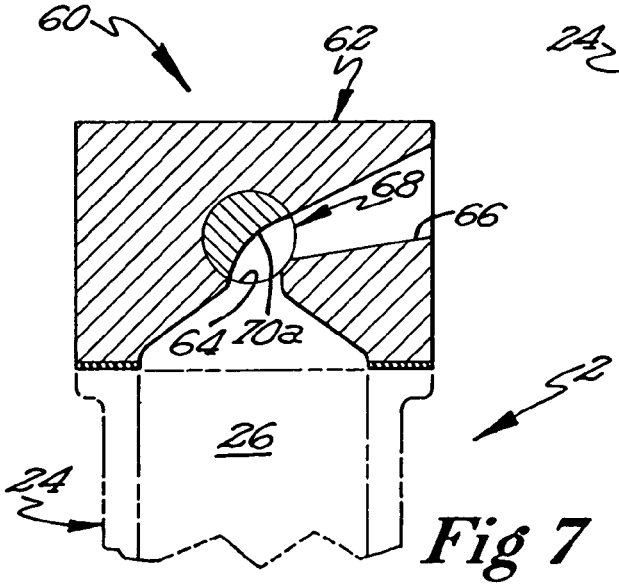
FIG. 7 is a cross-sectional schematic representation of the rotary valve of FIG. 6 wherein the valve cylinder of the rotary valve is in an open position and the piston head is moved away from the top of the cylinder.

Referring now to FIGS. 5–7 there is illustrated a rotary valve assembly 60 of the present invention. The rotary valve assembly 60 essentially comprises a valve body 62 having a cylindrical bore 64 formed therein. Where the valve assembly 60 is adapted for use with a four-cycle internal combustion engine, the valve body 62 will have formed there through an intake port 66*a* and an exhaust port 66*b*. While the specific geometry of the respective ports 66*a* and 66*b* may differ from one another, these ports are functionally equivalent. Therefore, when referring to an intake or exhaust port in general, the reference numeral 66 will be used.

Ports 66 are constructed and arranged to intersect the bore 64 formed into the valve body 62. A valve cylinder 68 is sized to be received within the bore 64 formed in the valve body 62 in a tight sliding fit. Port cutouts 70*a* and 70*b* are formed in the side of valve cylinder 68 adjacent the ports 66*a* and 66*b*, respectively. Where referring to a specific port cutout the reference numerals 70*a* or 70*b* will be utilized. However, where reference is made to a port cutout in general, the reference numeral 70 will be used.

As can be appreciated from FIGS. 6 and 7, valve cylinder 68 may be rotated within the bore 64 in the valve body 62 so as to occlude a port 66. When the valve cylinder 68 is in such a position, there is no fluidic communication through the port 66. FIG. 6 illustrates the valve cylinder 68 in a closed position in which there is no fluidic communication through the port 66. In FIG. 6 the cutout 70 is rotated away from the port 66 and the tight fit between the cylinder 68 and the bore 64 prevents the leakage of gases therebetween.

While exhaustive investigation of the present invention and all of its operating characteristics have not been undertaken, it has been shown through the creation of a working model that a rotary valve assembly 60 of the present invention may be successfully employed without observable leakage of high pressure gasses. While sealing mechanisms of various stripe, including standard ring-type seals, may be employed with the rotary valve assembly 60 of the present invention, it is to be understood that such sealing mechanisms are optional, and in a preferred embodiment, such sealing mechanisms are omitted. In the aforementioned working model of the rotary valve 60 adapted for use with a five horsepower, four-cycle engine, the rotating valve cylinder 68 included no sealing mechanism. The valve cylinder 68 of this embodiment was fashioned of a bronze alloy and was received in a steel sleeve that formed the bore 64 of the valve body 62. The valve cylinder 68 of this embodiment fitted the bore 64 within a tolerance of between 3–5 ten thousandths of an inch. After approximately 100 hours of operation, the working model of the present invention exhibited no appreciable wear and no leakage of gases was remarked.

FIG. 7 illustrates the valve cylinder 68 in a fully open position in which the port cutout 70 is completely aligned with the port 66 and there is fluidic communication through port 66. As the valve cylinder 68 rotates, the degree of exposure of the cutout 70 to port 66 will vary from fully closed (as seen in FIG. 6) to fully open (FIG. 7) and back to fully closed (FIG. 6). The exact rotational position of the valve cylinder 68 within the valve body 62 in relation to the position of the piston head 28 at various stages in the operation of engine 2 will be described in more detail herein below.

FIGS. 14–18 illustrate schematically the relative positions of the port cutouts 70 formed in the rotating valve cylinder 68. As the rotating valve cylinder 68 rotates, port cutout 70 become aligned with ports 66 formed through the valve body 62 so as to allow fluidic communication through the valve body 62 and into the cylinder 26. Each of the FIGS. 14–18 is comprised of two parts, respectively labeled a and b. Part "a" of these Figures illustrates a cross-sectional view of the rotary valve assembly 60 taken through the intake ports 66*a*. Part "b" of FIGS. 14–18 illustrate cross-sectional views of the rotary valve assembly 60 taken through the exhaust ports 66*b*. FIGS. 14–18 therefore illustrate the position of the port cutouts 70*a* and 70*b* with respect to ports 66*a* and 66*b*, respectively, during each stroke of the four-stroke internal combustion engine's cycle.

Figure 14A:
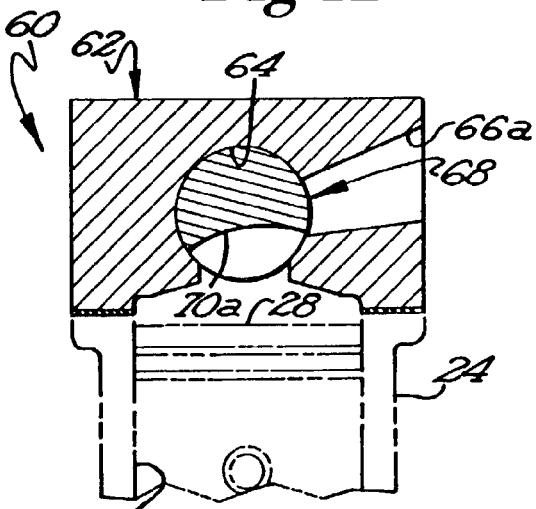
FIGS. 14*a* and 14*b* illustrate the position of the respective intake and exhaust port cutouts of the valve cylinder when the engine is at the beginning of its induction stroke.
Figure 14B:
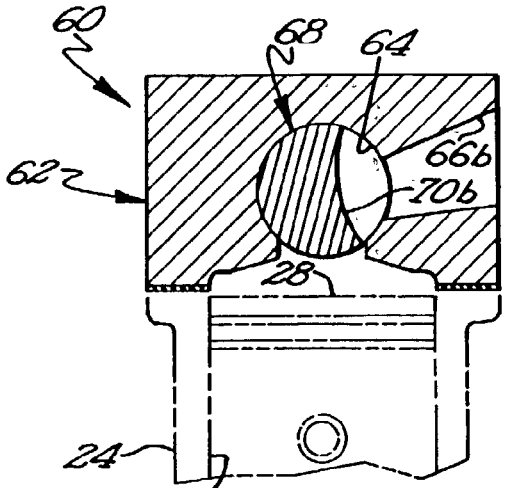

FIGS. 14*a* and 14*b* illustrate the position of the port cutouts 70*a* and 70*b* of valve cylinder 68 when the internal combustion engine 2 is positioned at top dead center (0° degrees) at the beginning of the induction stroke of the engine. Note that at the beginning of the induction stroke, when the piston 28 is at top dead center, the valve cylinder 68 is rotatably positioned such that the intake port cutout 70*a* and the exhaust port cutout 70*b* are both slightly open. Therefore, for a brief period of time there exists a path of fluidic communication from the intake port into the cylinder 26 and through the exhaust port 66*b* of the valve assembly 60. During this brief window, combustion gases remaining within the cylinder 26 are swept out (or scavenged), ensuring that the cylinder 26 are emptied of combustion gases as the induction stroke begins. The exhaust port cutout 70*b* may be fully closed within 2 to 5 degrees past top dead center. However, the closure of the exhaust port 66*b* may be delayed as long as approximately 18° past top dead center to facilitate the inflow of the fuel/air mixture.

Figure 15A:
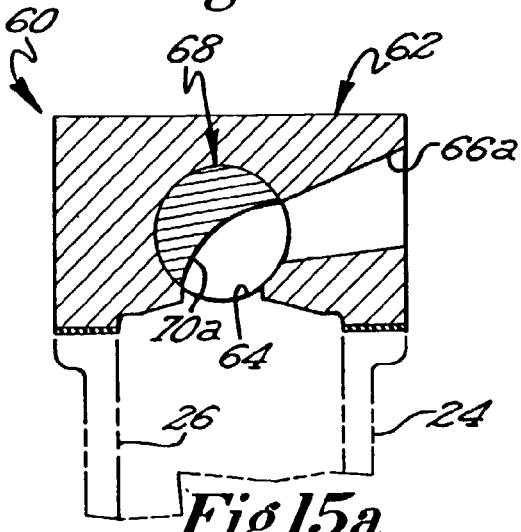
FIGS. 15*a* and 15*b* illustrate the position of the port cutouts of the valve cylinder when the engine is has rotated approximately 45° past top dead center in its induction stroke.
Figure 15B:
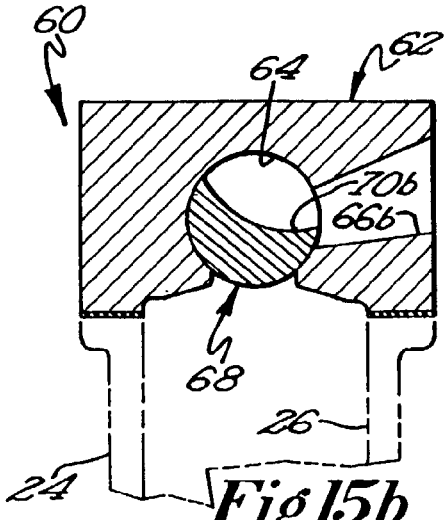

As illustrated in FIGS. 15*a* and 15*b* the intake port cutout 70*a* will have fully opened intake port 66*a* by the time the crankshaft 32 has rotated approximately 45 degrees past top dead center. Note that ports 66, when opened, form extremely large flow passages having few sharp edges. The size and arrangement of ports 66 therefore allow for relatively higher flow rates and an even distribution of air and fuel/air mixtures within the cylinders 26. Specifically, the flow rates realized through ports 66 are much greater than flow rates that are typically found through ports 44, 46 governed by poppet-type valves 34. It should also be pointed out that the ports 66 defined by the valve cylinder 68 are due the cutouts 70 that are formed on the exterior of the valve cylinder 68, rather than through the valve cylinder. This facilitates the manufacture of the valve cylinder 68 and the formation of the large flow passage described above.

Figure 16A:
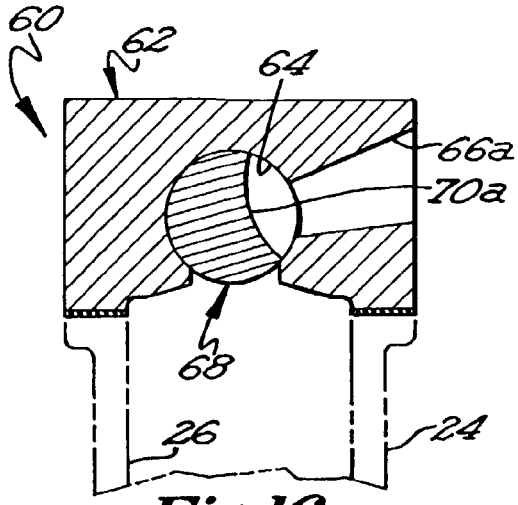
FIGS. 16*a* and 16*b* illustrate the position of the port cutouts of the valve cylinder when the engine is at the transition between its induction stroke and its compression stroke.
Figure 16B:
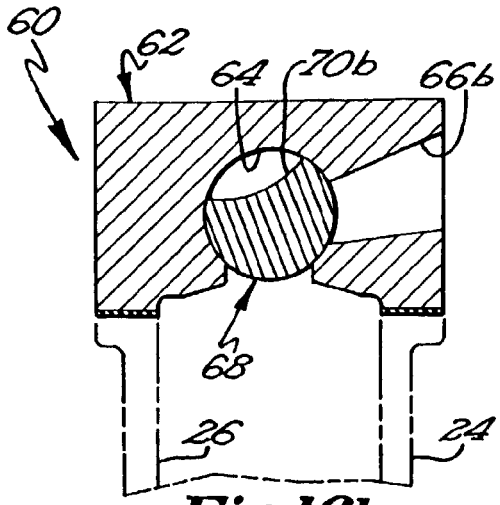

As the pistons 28 move towards bottom dead center at the end of the induction stroke and therefore to the beginning of the compression stroke, the rotation of the valve cylinder 68 will begin to rotate the intake cutout 70*a* out of alignment with the intake port 66A. This begins to occur at approximately 45 degrees before bottom dead center (crankshaft rotation of approximately 135 degrees). By the time the piston 28 has reached bottom dead center (crankshaft rotation of 180 degrees), the intake port 66*a* will be entirely occluded as illustrated in FIG. 16A. As illustrated in FIG. 16*b* the exhaust port 66*b* remains occluded. The intake port 66*a* will be fully closed at or slightly after the piston 28 reaches bottom dead center. Intake port 66*a* will be entirely occluded no later than 2 degrees past bottom dead center (182 degrees of crankshaft rotation). Note that the intake port 66*a* remains open much longer than would a similar intake valve of a poppet type valve assembly.

Both the intake and exhaust ports 66*a* and 66*b* remain completed occluded during the compression stroke and well into the power stroke of the four-stroke internal combustion engine 2. As the piston 28 moves towards top dead center, at approximately 25 to 35 degrees before top dead center of the compression stroke (between 325 and 335 degrees of crankshaft rotation), the compressed fuel/air mixture present within the cylinder 26 is ignited by the introduction of a spark into the cylinder by a spark plug (not shown). As can be understood by those skilled in the art, sparkplugs are typically used in internal combustion engines that burn gasoline whereas internal combustion engines that burn diesel rely on the compression of the fuel/air mixture or upon glow plugs to induce combustion in the cylinder.

Figure 17A:
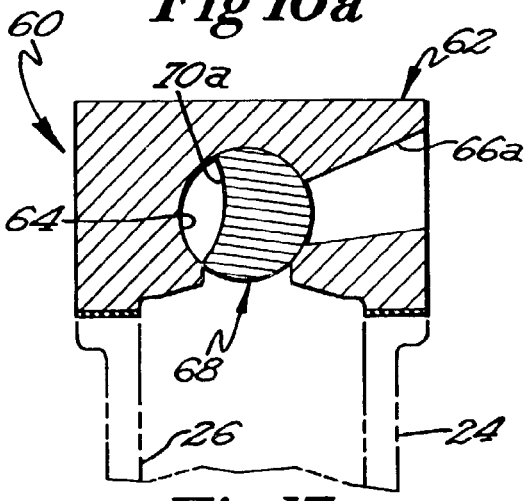
FIGS. 17*a* and 17*b* illustrate the position of the port cutouts of the valve cylinder when the engine is within 10° to 15° of bottom dead center of its power stroke.
Figure 17B:
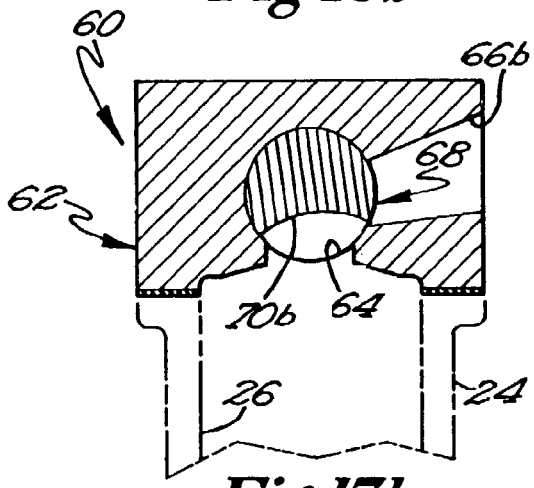
Figure 18A:
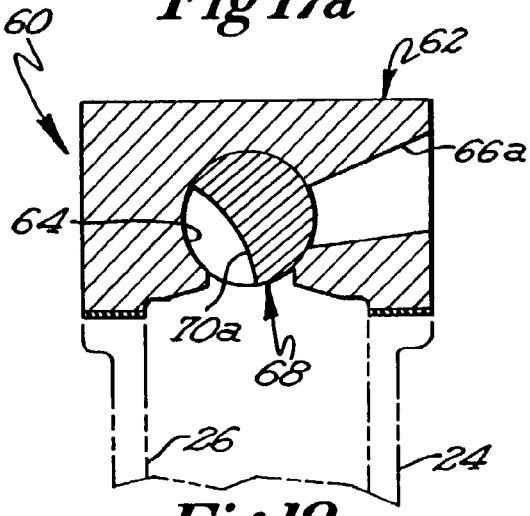
FIGS. 18*a* and 18*b* illustrate the position of the port cutouts of the valve cylinder when the engine is in its exhaust stroke.
Figure 18B:
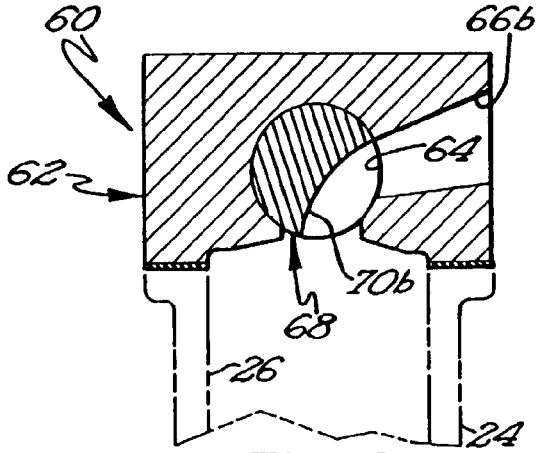

The intake and exhaust ports 66*a* and 66*b* remain occluded by the valve cylinder 68 through the majority of the power stroke. The valve cylinder 68, by the time the piston 28 is within 10 to 15 degrees of bottom dead center of the power stroke (between 535° and 540° of crankshaft rotation), begins to open the exhaust port 66*b* as illustrated in FIG. 17*b*. The valve cylinder 68 will rotate approximately 45 degrees to fully open the exhaust port 66*b* as illustrated in FIG. 18B. Accordingly, the exhaust port 66*b* will have been fully opened by the time piston 28 is 30 to 35 degrees into the exhaust stroke of the internal combustion engine 2 (approximately 570 to 575 degrees of crankshaft rotation). Completion of the exhaust stroke ends the four-stroke cycle of the internal combustion engine 2 and brings the valve assembly 60 back to the position illustrated in FIGS. 14*a* and 14*b*.

Throughout the four-stroke cycle, the rotary valve assembly 60 provides a greater degree of fluidic communication between the cylinder 26 and the exterior thereof than would a standard poppet type valve assembly 20. In addition, where needed, the rotating valve assembly 60 of the present invention seals the cylinder 26 for longer periods during the four-stroke cycle than a poppet type valve assembly 20 is able to. Consequently, an engine 2 fitted with a rotary-type valve assembly 60 allows for more efficient intake of air or fuel/air mixtures into the cylinder 26, provides for longer and more complete compression during the compression stroke of the four-stroke cycle, and allows for longer and more complete combustion of the fuel/air mixture within the cylinder.

Cylinder 68 is preferably driven at approximately ½ the speed at which the crankshaft 32 rotates. This may be simply accomplished as illustrated in FIG. 5 by using of a timing belt or chain 74 coupled between the crankshaft 32 and the valve cylinder 68. In order to step down the speed of the crankshaft 32, a pulley or sheave (not shown) attached to the crankshaft 32 will be one half the size of the pulley or sheave 72 that is secured to an end of the valve cylinder 68 that extends from the valve body 62. As indicated above, belt 74 that drives the valve cylinder 68 maybe a tooth belt or a chain as needed.

In a preferred embodiment of the rotating valve assembly 60, the valve body 62 or more specifically, the material that forms the bore 64 of the valve assembly 60, will be fashioned of a material that is slightly harder and more wear resistant than that of the valve cylinder 68. In this way, wear on the valve assembly 60 will occur primarily in the valve cylinder 68. When compression within the cylinder 26 of the engine 2 falls below an acceptable level, the worn valve cylinder 68 may be removed and replaced with a replacement valve cylinder sized to fit the bore 64 formed within the body 62 within a predetermined tolerance. The cylinder 68 may be formed of a bronze alloy, a graphite impregnated ceramic composite material or any other suitable material. In this manner, the rotating valve assembly 60 may be easily and cheaply maintained so as to preserve a desirable tolerance between the valve cylinder 68 and the valve body 60. This will in turn maintain a desired compression level within an operating cylinder 26 of engine 2. In addition, because of the simplicity of the rotating valve assembly 60, there are fewer parts that require maintenance or adjustment than with a standard poppet-type valve assembly 20.

Figure 11:
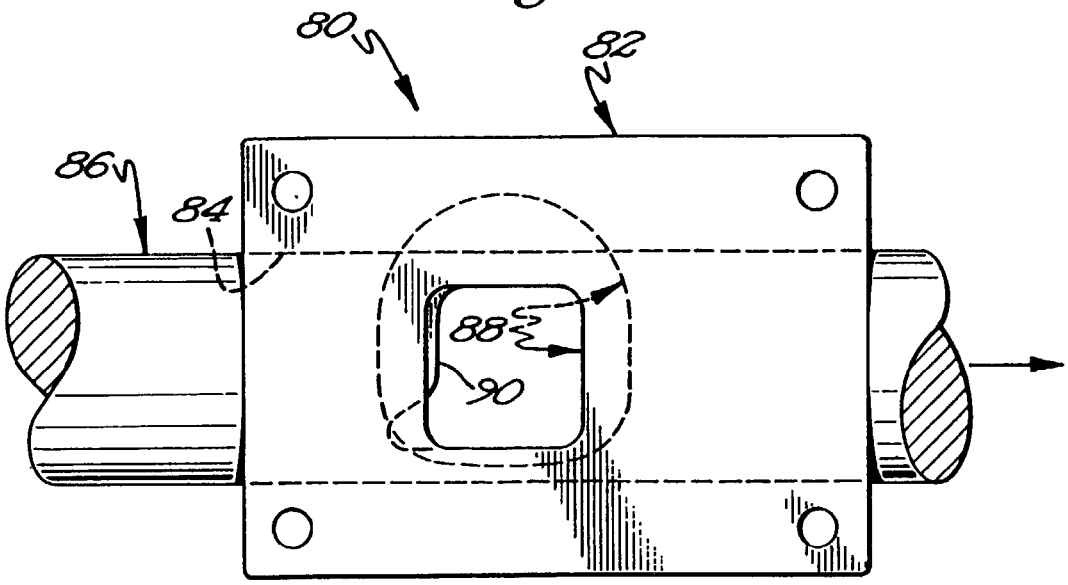
FIG. 11 is a close-up view through a port formed in the valve body wherein the valve cylinder is in its "wide-open" throttle position.
Figure 10:
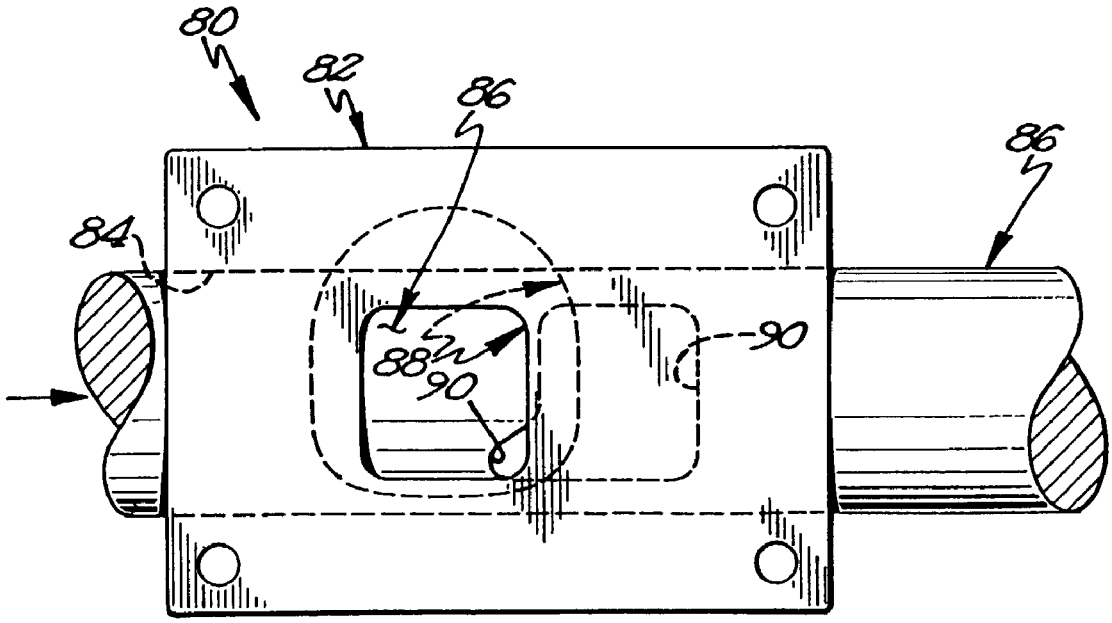
FIG. 10 is a close-up view through the valve body wherein the valve cylinder is in its "idle" throttle position.

In its simplest form, the valve cylinder 68 is simply a cylinder having a flat(s) machined into its side to form the cutouts 70. These cutouts 70 may be of any suitable geometry but will preferably direct flow through the ports 66 in a smooth and efficient manner. As illustrated in FIGS. 10 and 11, the cutouts 70 may have a longitudinally oriented channel 91 formed therein to modify the flow characteristics through the cutouts 70 when the valve assembly 60 is simultaneously used as a throttling device as described hereinbelow in more detail. In addition, the cutouts 70 may be formed with circumferentially extending channels or slots (not shown) of varying size, shape, and disposition that act to control air flow through the ports in a desired manner. Geometrically regular cutouts 70 may have none or one or both types of channels or slots formed therein to control the flow of gases therethrough. It is also to be understood that channels of these shapes may be obviated by forming cutouts with complex geometric shapes that facilitate the flow of gases in a prescribed manner. This flexibility also extends to the exact timing of the opening and closing of the ports 66. As can be appreciated by those skilled in the art, the timing of the opening and closing of the ports 66 will in large part be dictated by the application for which the engine is intended. The shape, disposition and orientation of the cutouts 70 are therefore not to be limited to just those arrangements shown or described herein.

The valve cylinder 68 is also suitable for the application of exhaust gas return (EGR) mechanisms. In their simplest form, EGR mechanisms might comprise a channel or bore formed through the valve body that would allow for fluidic communication between the ports 66*a* and 66*b* during predetermined intervals. These channels or ports may be of a predetermined size and arrangement to control the flow of gases therethrough. FIG. 5 illustrates schematically an embodiment of an EGR mechanism 63 that is a channel that connects cut-outs 70*a* and 70*b*.

While FIGS. 1–18 are schematic in nature, they are illustrative of the simplicity of the rotating valve assembly 60 of the present invention. Ideally, the simple rotary valve assembly 60 may be constructed and arranged so as to replace a preexisting poppet type valve assembly of the type illustrated in FIGS. 1–4. In this manner, engines 2 currently utilizing poppet-type valve assemblies 20 may be retrofit with the rotating valve assembly 60 of the present invention. What is more, the simplicity of the rotating valve assembly 60 offers engine designers greater flexibility in the design of the architecture of an engine 2. For instance, coolant channels (not shown) may be run directly through the solid body 62 of the rotating valve assembly 60 or even through the valve body 68 itself so as to cool the rotating valve assembly. Presently, cooling of a poppet-type valve assembly is limited to relatively compact structures such as sodium filled poppet valve stems 40.

Figure 8:
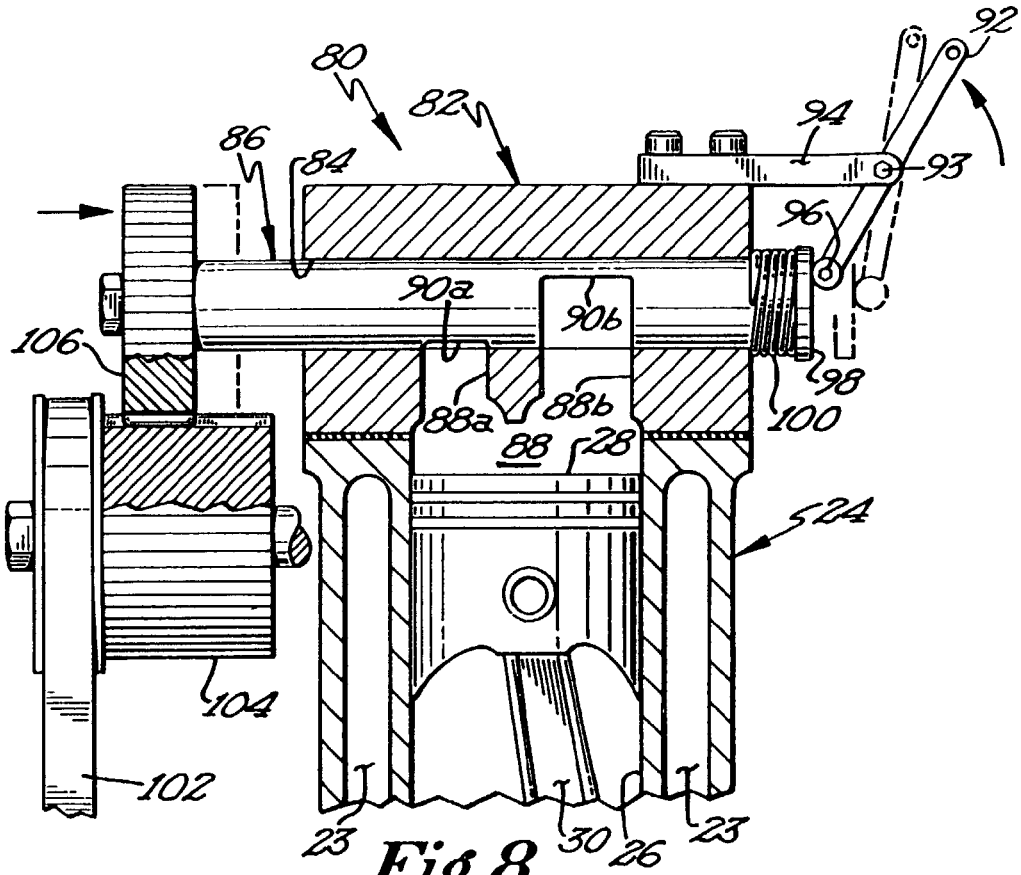
FIG. 8 is a cross-sectional schematic representation of the rotary valve of the present invention further incorporating a throttling mechanism. The rotary valve is illustrated in its "wide-open" throttle position.

As indicated above, a rotating valve assembly 60 of the type illustrated in FIG. 5 will have connected to its intake port 66*a* a carburetor or fuel injection system that will provide the fuel/air mixture that will be introduced into the cylinder of the engine 2. The exhaust port 66*b* of the rotating valve assembly 60 is connected to a manifold (not shown) of the exhaust system of the engine 2. Where so desired, a rotating valve assembly 60 of the type illustrated in FIG. 5 may be adapted as illustrated in FIG. 8 so that a carburetor or fuel injection system may be omitted. In its place, a simple chamber (not shown) for mixing fuel and air may be used.

Figure 9:
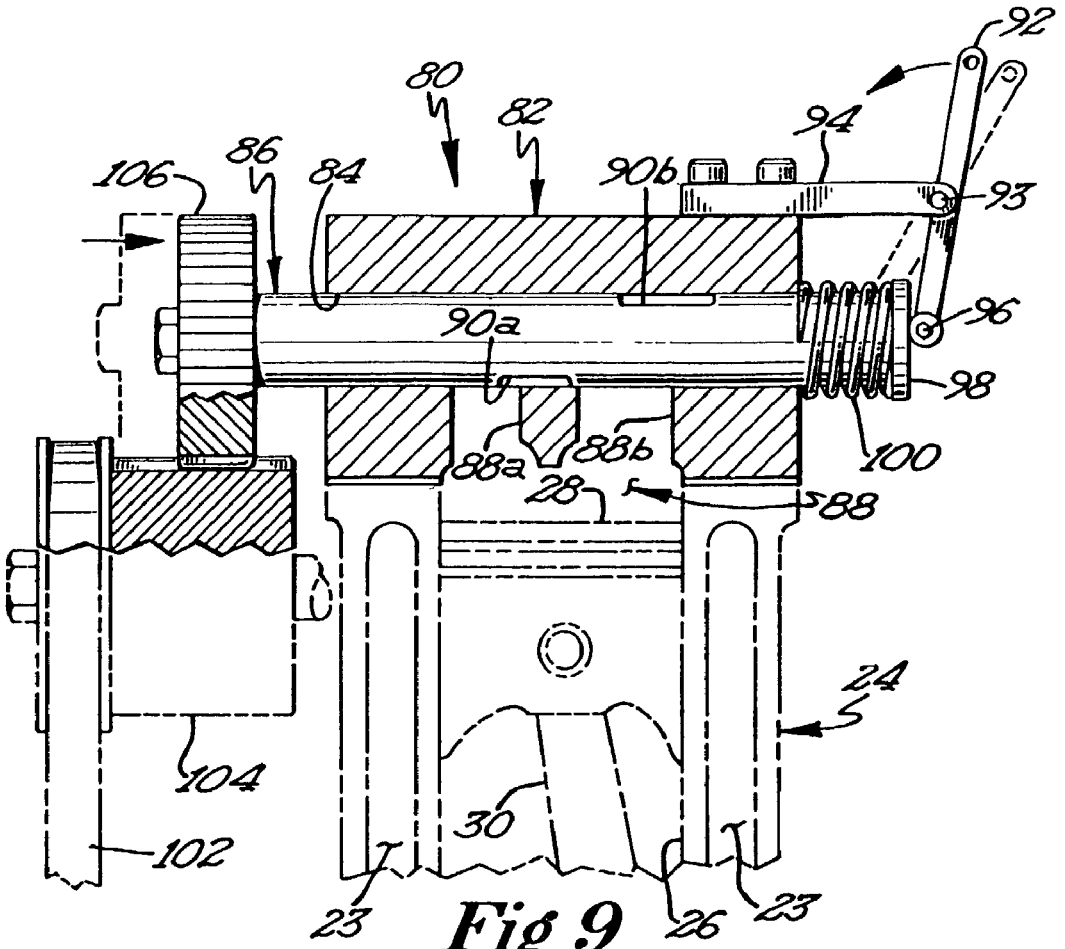
FIG. 9 is a schematic representation of the rotary valve of FIG. 8 wherein the valve cylinder of FIG. 9 is in its "idle" throttle position.

The rotating valve assembly 80 illustrated in FIG. 8 comprises a body 82 having a bore 84 formed entirely therethrough. Because the engine 2 illustrated in FIG. 8 is a four-cycle engine, body 82 is provided with an intake port 88*a* and an exhaust port 88*b*. Port cutouts 90*a* and 90*b* formed in the valve cylinder 86 are constructed and arranged to open and seal the ports 88 in the manner illustrated in FIGS. 14–18. The main difference between rotating valve assembly 60 and rotating valve assembly 80 is that the valve cylinder 86 of rotating valve assembly 80 is longitudinally movable within the bore 84 of body 82. In this manner, the aspect of the port cutouts 90*a* and 90*b* that addresses their respective ports 88*a* and 88*b* as the engine 2 runs through a four-stroke cycle may be strictly controlled. In order to accomplish this longitudinal motion, a throttle assembly comprising a lever arm 92 that is rotatably mounted upon beam 94 is provided. Beam 94 is solidly secured to body 82 of the rotating valve assembly 80. Lever 92 rotates about pin 93 such that an end 96 of lever 92 may bear against an end of valve cylinder 86. Preferably, valve cylinder 86 will be longitudinally biased within bore 84 into a first, "idle" position as illustrated in FIG. 9. This is achieved by securing a collar 98 to the end of valve cylinder 86 that is addressed by the lever 92. A spring 100 is retained around the valve cylinder 86 between the body 82 and collar 98, thereby acting to bias the valve cylinder 86 to the right into its "idle" position. Note that in FIG. 8 lever 92 has been actuated to slide the valve cylinder 86 to a second, "wide open throttle" position in which the entire port cutouts 90*a* and 90*b* are addressed to their respective intake and exhaust ports 88*a* and 88*b*.

By moving the valve cylinder 86 longitudinally within the bore 82, the flow rate of air or fuel/air mixtures and exhaust into and out of the cylinder 26 may be controlled. Control of the flow rate of the air or air/fuel mixture and combustion gases to and from the cylinder 26 allows operator of engine 2 to control the speed at which the engine will operate. While a mechanism such as a port injector for mixing air and fuel will still be needed in a gasoline powered engine, the more complex throttle mechanisms associated with carburetors and fuel injection systems may be omitted where the valve assembly 80 is utilized.

The valve cylinder 86 of valve assembly 80 is preferably driven at one-half the rotational speed of the crankshaft 36. A belt or chain 102 drives an elongate spur gear 104. Elongate spur gear 104 in turn drives a spur gear 106 that is secured to an end of the valve cylinder 86. Spur gear 104 is spatially fixed, i.e. is not moveable longitudinally. However, because of its greater width, gear 106 of valve cylinder 86 may move across the face of gear 104 while maintaining driving contact therewith. In this manner, valve cylinder 86 may be continuously driven while simultaneously being moved longitudinally within bore 84 of valve body 82. Note that the ratio of the gears and pulleys which connect the crankshaft 32 to the valve cylinder 86 must be such that the angular speed of the valve cylinder 86 is approximately one half that of the crankshaft 32.

It must be understood that many different mechanisms may be utilized to provide motive power to the valve cylinder 86 and to longitudinally slide the valve cylinder 86 within its bore 84. For example, a worm gear may be utilized in place of the lever 92. The range of mechanisms capable of sliding the valve cylinder 86 longitudinally within its bore 84 or of providing motive power to the valve cylinder 86 is not to be limited to the embodiments described or illustrated in the Figures.

FIGS. 10 and 11 are close-up views of a port cutout 70 of valve cylinder 86 through a port 88. In FIG. 10 a valve cylinder 86 is illustrated in its first, idle position.

Note that only a small aspect 91 of port cutout 90 is exposed to the port 88. In this position, only a limited amount of fuel or fuel/air mixture may flow through the port 88. The exit of combustion gases from the cylinder is similarly restricted, however the exhaust port cutout 90*b* may be sized to exposed a relatively larger aspect to the exhaust port 88*b* at any given time. In FIG. 11, the valve cylinder 86 has been slid to its second, wide-open throttle position. In this position, the maximum aspect of the port cutout 90 is addressed to the port 88. This permits the maximum flow of air or fuel/air mixture into the cylinder and the maximum flow of combustion gases from the cylinder of engine 2. When valve cylinder 86 is in its idle position as illustrated in FIG. 10, the speed of engine 2 is at its minimum. When the valve cylinder 86 is in the position illustrated in FIG. 11, the operational speed of engine 2 is at its maximum. By exposing a predetermined aspect of the port cutout 90 to the port 88, the engine 2 may be driven at a desired speed. As can be appreciated, the use of the relatively simple rotating valve assembly 80 may obviate the use of more complex carburetor or fuel injection systems.

In a two stroke internal combustion engine, a cylinder 120 of the engine typically has an exhaust port (not shown) formed through the cylinder wall such that as the piston of the engine moves downward in its power stroke, the piston head will expose the exhaust port and combustion gases will escape through the exhaust port. Note that such an exhaust port does not incorporate a valve as such, though one may be included. This structure requires the use of fixed rings on the piston of the engine so as to avoid damage to the rings and piston were the rings to become snagged on the exhaust port. Such an engine is of simple construction but fails to achieve a satisfactory level of efficiency.

Figure 12:
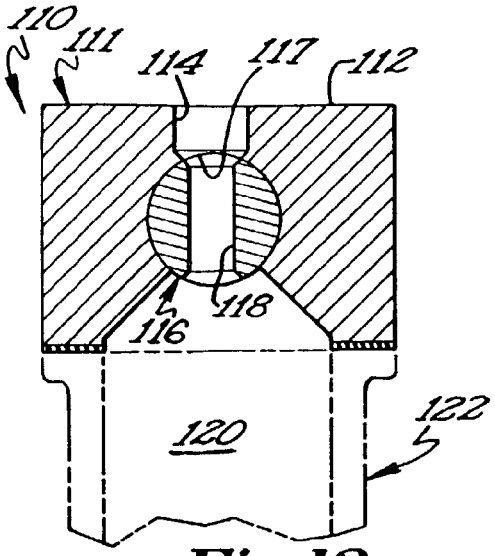
FIG. 12 is a schematic representation of a two-cycle internal combustion engine featuring a rotary valve of the present invention. The valve cylinder is illustrated in its open position in FIG. 12.
Figure 13:
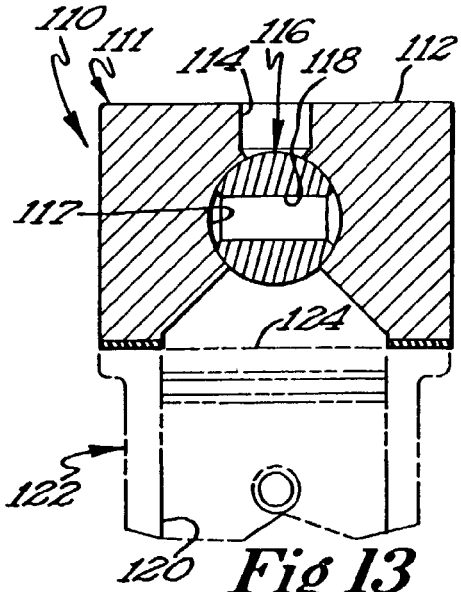
FIG. 13 is a schematic cross-sectional illustration of a two-stroke engine wherein the valve cylinder of the rotary valve is in its closed position.

In another embodiment of the present invention, a rotating valve assembly 110 may be adapted for use with a two-stroke engine 110. A schematic cross section view of a port of this embodiment is illustrated in FIGS. 12 and 13. Rotating valve assembly 110 comprises a body 112 having a port 114 formed entirely therethrough. A valve cylinder 116 is rotatably disposed within a bore 117 formed through the body 110. A port bore 118 is formed through the valve cylinder 116 such that as the valve cylinder 116 is rotated, the port bore 118 will selectively open a path of fluidic communication through the port 114 into a cylinder 120 of engine block 122. FIG. 12 illustrates the valve cylinder 116 orientated such that port bore 118 allows fluidic communication with the interior of cylinder 120 through port 114. In FIG. 13, valve cylinder 116 of rotating valve assembly 110 is rotated such that the port 114 formed through body 112 is entirely occluded.

It is envisioned that the valve body 112 of valve assembly 110 may have an intake port and an exhaust port formed therethrough in the same manner as the valve assemblies illustrated in FIGS. 5 and 8. Similarly, valve cylinder 116 of valve assembly 110 may have two port bores 118 formed therethrough, the port bores 118 corresponding to respective ports 114. Where valve assembly 110 is so constructed, the exhaust port typically formed through the cylinder wall may be excluded in favor of the exhaust port 114 in the valve assembly 110. This allows for more efficient combustion, better compression in the cylinder 120, and less maintenance of the engine. In addition, the valve assembly 110 may also be adapted to act as a throttle in the same manner as illustrated in FIGS. 8 and 9. The rotating valve assembly 110 may also be adopted as an intake pathway alone, with a fuel/air mixture entering the cylinder 120 through port 114 and passage 118 and exhaust gases exiting cylinder 120 through a typical two-stroke engine exhaust port (not shown).

In operation, the exhaust port of valve assembly 110 will be opened by the valve cylinder 116 as the piston moves past a predetermined point in its power stroke. The opening of the intake port of the valve assembly 110 will lag behind the opening of the exhaust port as in a typical two stroke engine. For a time prior to bottom dead center of the first or power stroke and past bottom dead center of the second or compression stroke of the two stroke engine, the port bores 118 of both the intake and exhaust ports 114 will be open simultaneously. Thereafter, both the exhaust and intake port bores will be rotated out of alignment with ports 114, thereby sealing the cylinder 120 as is typical during the second, compression stroke of the two stroke engine.

Typically a valve cylinder of a rotating valve assembly 110 that is constructed and arranged for use with a two-stroke internal combustion engine will operate at approximately the same rotational speed as the crankshaft of the two-stroke engine 110.

The invention described above may be embodied in other forms without departing from the spirit or essential characteristics thereof. The embodiments disclosed in this application are to be considered in all respects as illustrative and not restrictive. The scope of the invention is indicated by the appended claims rather than by the foregoing description and all changes, which come within the meaning and range of equivalency of the claims, are intended to be embraced therein.

What is claimed is:

1. A rotary valve mechanism comprising: a valve body having a bore formed therein and an exhaust port formed therethrough that intersects the bore and an intake port formed therethrough that intersects the bore; and a solid valve cylinder constructed and arranged to be rotatably received within the bore formed in the valve body, the valve cylinder having formed into the cylindrical surface thereof first and second cutouts that respectively corresponds to the intake and exhaust ports formed through the body, the first cutout being constructed and arranged to address the intake port, thereby selectively permitting fluidic communication through the intake port of the valve body as the valve cylinder rotates within the bore, the second cutout being constructed and arranged to address the exhaust port, thereby selectively permitting fluidic communication through the exhaust port of the valve body as the valve cylinder rotates within the bore.

2. The rotary valve mechanism of claim 1 wherein the intake and exhaust ports and first and second cutouts are constructed and arranged so as to implement the proper valve sequence of a four-stroke internal combustion engine.

3. The rotary valve mechanism of claim 1 wherein the valve cylinder further comprises a channel extending longitudinally along the valve cylinder and which is in fluidic communication with the first and second cutouts.

4. The rotary valve mechanism of claim 1 wherein at least one of the first and second cutouts further comprises a channel extending circumferentially around the valve cylinder and which is in fluidic communication with the at least one of the first and second cutouts.

5. The rotary valve mechanism of claim 1 wherein at least one of the first and second cutouts is formed entirely on the exterior of the valve cylinder.

6. The rotary valve mechanism of claim 1 wherein the first and second cutouts each comprise a bore formed through the valve cylinder so as to implement the proper valve sequence of a two-stroke internal combustion engine.

7. The rotary valve mechanism of claim 2 wherein the valve body is coupled to a cylinder of a four stroke internal combustion engine and wherein the valve cylinder of the rotary valve is coupled to a crankshaft of the engine.

8. The rotary valve mechanism of claim 1 further comprising a bore formed through the body of the valve cylinder that selectively creates fluidic communication between the intake port and the exhaust port.

9. The rotary valve mechanism of claim 1 further comprising a channel formed on the outer surface of the valve cylinder that selectively creates fluidic communication between the intake port and the exhaust port.

10. The rotary valve mechanism of claim 1 wherein the intake port cutout is constructed and arranged to remain in an open position during substantially an entire induction stroke of a four stroke engine.

11. The rotary valve mechanism of claim 1 wherein the intake port cutout is constructed and arranged to be fully opened within 45 degrees of rotation of the crankshaft to which the valve cylinder is coupled.

12. The rotary valve mechanism of claim 1 wherein the cross-sectional area of the ports describes a solid area.

13. The rotary valve mechanism of claim 1 wherein the intake port remains open for between 180 and 182 degrees of rotation of a crankshaft to which the valve cylinder is coupled.

14. The rotary valve mechanism of claim 1 wherein the exhaust port begins to open at between 535 degrees and 540 degrees of rotation of a crankshaft to which the valve cylinder is coupled as measured from top dead center of the beginning of an engine cycle.

15. The rotary valve mechanism of claim 14 wherein the exhaust port is fully open within 45 degrees of rotation of the crankshaft to which the valve cylinder is coupled, as measured from the start of opening of the exhaust port.

16. The rotary valve mechanism of claim 1 wherein the exhaust port is fully closed at approximately 18 degrees of rotation of a crankshaft to which the valve cylinder is coupled, as measured from top dead center of the beginning of an engine cycle.

17. The rotary valve mechanism of claim 14 wherein the exhaust port is fully opened between 570 degrees and 575 degrees of rotation of the crankshaft to which the valve cylinder is coupled as measured from top dead center of the beginning of an engine cycle.

18. The rotary valve mechanism of claim 7 wherein the valve cylinder rotates at approximately ½ the rotational speed of the crankshaft.

19. A rotary valve and throttle mechanism comprising: a valve body having a bore formed therein and an exhaust port formed therethrough that intersects the bore and an intake port formed therethrough that intersects the bore; and a valve cylinder constructed and arranged to be rotatably received within the bore formed in the valve body, the valve cylinder having formed into the cylindrical surface thereof first and second cutouts that respectively corresponds to the intake and exhaust ports formed through the body, the first cutout being constructed and arranged to address the intake port, thereby selectively permitting fluidic communication through the intake port of the valve body as the valve cylinder rotates within the bore, the second cutout being constructed and arranged to address the exhaust port, thereby selectively permitting fluidic communication through the exhaust port of the valve body as the valve cylinder rotates within the bore, the valve cylinder being longitudinally slidable within the bore formed in the valve body such that the size of an aspect of each of the first and second cutouts that is addressed to its respective port may be controlled.

20. The rotary valve and throttle mechanism of claim 19 wherein the intake and exhaust ports and first and second cutouts are constructed and arranged so as to implement the proper valve sequence of a four-stroke internal combustion engine.

21. The rotary valve and throttle mechanism of claim 19 wherein the intake port of the rotary valve and throttle mechanism remains open during substantially the entire induction stroke.

22. A rotary valve and throttle mechanism comprising: a valve body having a bore formed therein and at least one port formed therethrough that intersects the bore; and a valve cylinder constructed and arranged to be rotatably received within the bore formed in the valve body, the valve cylinder having formed entirely therethrough at least one diametrical bore formed along a diameter of the valve cylinder and constructed and arranged to implement the proper valve sequence of a two-stroke internal combustion engine, the at least one bore being constructed and arranged to address its respective port thereby selectively permitting fluidic communication through the port of the valve body; the valve cylinder being longitudinally slidable within the bore formed in the valve body such that the size of an aspect of the at least one bore that is addressed to its respective port may be controlled.

23. The rotary valve and throttle mechanism of claim 19 wherein the bore is formed entirely through the valve body and wherein the valve cylinder and extends entirely through the bore formed through the valve body, a first end of the valve cylinder being operatively coupled to a crankshaft of an internal combustion engine such that the rotation of the crankshaft is transmitted to the valve cylinder regardless of the longitudinal location of the valve cylinder within the valve body, a second end of the valve cylinder having a biasing mechanism coupled thereto for longitudinally biasing the valve cylinder within the valve body into a first, idle, position, the valve body having coupled thereto an actuation mechanism constructed and arranged to act against the biasing mechanism so as to move the valve cylinder longitudinally within the valve body from its first, idle, position to a second, wide open, position.

24. The rotary valve and throttle mechanism of claim 19 further comprising a lever pivotally connected to the valve body such that an end of the lever bears against an end of the valve cylinder.

* * * * *